US010011045B2

(12) United States Patent
Wittbold et al.

(10) Patent No.: US 10,011,045 B2
(45) Date of Patent: Jul. 3, 2018

(54) SLURRY MIXER GATE WITH ENHANCED FLOW AND FOAMING GEOMETRY

(71) Applicant: UNITED STATES GYPSUM COMPANY, Chicago, IL (US)

(72) Inventors: James R. Wittbold, Des Plaines, IL (US); Chris C. Lee, Deerfield, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 322 days.

(21) Appl. No.: 14/686,154

(22) Filed: Apr. 14, 2015

(65) Prior Publication Data

US 2015/0328607 A1 Nov. 19, 2015

Related U.S. Application Data

(60) Provisional application No. 62/000,244, filed on May 19, 2014.

(51) Int. Cl.

| | |
|---|---|
| ***B01F 15/02*** | (2006.01) |
| ***B01F 3/04*** | (2006.01) |
| ***B01F 5/00*** | (2006.01) |
| ***B28C 5/08*** | (2006.01) |
| ***B28C 5/38*** | (2006.01) |

(Continued)

(52) U.S. Cl.

CPC ..... *B28C 5/0881* (2013.01); *B01F 3/0446* (2013.01); *B01F 3/1221* (2013.01); *B01F 5/008* (2013.01); *B01F 5/0071* (2013.01); *B01F 7/18* (2013.01); *B01F 15/0234* (2013.01); *B01F 15/0267* (2013.01); *B28C 5/386* (2013.01); *B01F 2003/1257* (2013.01)

(58) Field of Classification Search

CPC ..... B28C 5/386; B01F 5/0071; B01F 3/0446

See application file for complete search history.

(56) References Cited

U.S. PATENT DOCUMENTS

| | | | |
|---|---|---|---|
| 5,638,635 | A | 6/1997 | Palladino |
| 5,643,510 | A | 7/1997 | Sucech |
| 6,494,609 | B1 | 12/2002 | Wittbold et al. |

(Continued)

FOREIGN PATENT DOCUMENTS

| | | | |
|---|---|---|---|
| DE | 102008003738 | A1 | 7/2009 |
| WO | 2014112865 | A1 | 7/2014 |

OTHER PUBLICATIONS

Search Report from International Patent Application No. PCT/US2015/030078, dated Jul. 17, 2015.

(Continued)

*Primary Examiner* — Tony G Soohoo
*Assistant Examiner* — Elizabeth Insler
(74) *Attorney, Agent, or Firm* — Greer, Burns & Crain, Ltd.; Pradip K. Sahu; Philip T. Petti

(57) ABSTRACT

A discharge gate is provided for a gypsum slurry mixer, and includes a lower member having an inlet opening configured for receiving the slurry, and an outlet opening configured for delivering the slurry to a dispensing device. An upper member is attached to the lower member, at least one of the upper and lower members having at least one opening for accommodating insertion of an injection port for introducing the foam to the slurry. A cavity is configured for mixing the foam and slurry, and is defined by inner surfaces of the lower member and the upper member.

6 Claims, 6 Drawing Sheets

(51) Int. Cl.
*B01F 3/12* (2006.01)
*B01F 7/18* (2006.01)

(56) References Cited

U.S. PATENT DOCUMENTS

| | | | | |
|---|---|---|---|---|
| 6,874,930 | B2 | 4/2005 | Wittbold et al. | |
| 2004/0062141 | A1* | 4/2004 | Shrader | B01F 5/0646 366/155.1 |
| 2005/0248049 | A1 | 11/2005 | Gannaway et al. | |
| 2012/0287748 | A1 | 11/2012 | Pourcel et al. | |
| 2015/0315074 | A1 | 11/2015 | Ueno et al. | |

OTHER PUBLICATIONS

International Search Report from International Application No. PCT/US2015/055630, dated Mar. 15, 2016.

* cited by examiner

SLURRY MIXER GATE WITH ENHANCED FLOW AND FOAMING GEOMETRY

RELATED APPLICATION

The present application claims priority under 35 USC 119(e) based on U.S. Provisional Application No. 62/000,244 filed May 19, 2014.

BACKGROUND

The present disclosure generally relates to a method and apparatus for preparing gypsum products from starting materials including calcined gypsum and water, and more particularly relates to an improved apparatus for use in conjunction with a slurry mixer used in supplying agitated gypsum slurry to a wallboard production line.

It is well known to produce gypsum products by dispersing calcined gypsum in water to form a slurry, then casting the slurry into a desired shaped mold or onto a surface, and allowing the slurry to set to form hardened gypsum by reaction of the calcined gypsum (calcium sulfate hemihydrite or anhydrite) with the water to form hydrated gypsum (calcium sulfate dihydrate). It is also well known to produce a lightweight gypsum product by mixing an aqueous foam into the slurry to produce air bubbles. This will result in a desired distribution of voids in the set gypsum product if the bubbles do not escape from the slurry before the hardened gypsum forms. The voids lower the density of the final product, which is often referred to as "foamed gypsum."

Prior apparatus and methods for addressing some of the operational problems associated with the production of foamed gypsum are disclosed in commonly-assigned U.S. Pat. Nos. 5,638,635; 5,643,510; 6,494,609; and 6,874,930; all of which are incorporated by reference. The present invention relates generally to mixers used in the formulation of gypsum slurries in the production of gypsum wallboard.

A gypsum wallboard mixer typically includes a housing defining a mixing chamber with inlets for receiving sources of calcined gypsum and water, among other additives well known in the art. The mixer includes an impeller or other type of agitator for agitating the contents to be mixed into a mixture or slurry. Such mixers typically have a rectangular discharge gate or slot with a cutoff block or door. The discharge gate controls the flow of slurry from the mixer, but is difficult to adjust to change slurry flow when product requirements change, such as when thicker or thinner wallboard is desired.

Foam and/or other additives are typically added through a foam injection port on an outer side wall of the discharge gate through which aqueous foam or other desired additives, such as retarders, accelerators, dispersants, starch, binders, and strength-enhancing products including poly-phosphates, sodium trimetaphosphate, and the like, after the slurry has been substantially mixed. To promote more uniform mixing of foam or other additives into the gypsum slurry, designers have the goal of preventing the foam and/or additives from flowing backwards and entering into the mixing chamber to prematurely mix with the gypsum slurry.

An inlet opening of the discharge gate for receiving the mixed slurry is typically equipped with lump bars or grating for preventing slurry lumps from entering into the discharge gate. As a result, in some applications, the inlet opening is configured to be large and oversized, and causes slurry flow problems when the foam and/or additives are injected into a cavity of the discharge gate. Specifically, the large inlet opening of the discharge gate makes it difficult to match the cavity area to the volume of mixed slurry flowing through from the inlet opening to an outlet opening of the discharge gate. If the grate is not full, lumps can form from eddy patterns created by the slurry flow in the mixer.

Thus, several factors combine to provide a gypsum wallboard mixer that operates properly, and these include the size of the discharge gate, whether or not lump bars obscure the gate opening, the volume of slurry in the mixer, and the point of introduction of foam into the slurry.

Therefore, there is a need for an improved discharge gate having the injection port that provides the desired 90° injection angle, and the cavity area that matches the volume of mixed slurry flowing through the mixer.

SUMMARY

The present disclosure provides an apparatus that promotes an improved slurry flow and mixture inside the discharge gate, and provides an improved injection port configuration. In the prior art mixers, the foam is introduced to the slurry after the slurry exits the gate. An important aspect of the present discharge gate is that the gate has an injection port that is positioned at a 90° angle relative to a running or flow direction of the mixed slurry flow through the gate. The injection point or points are preferably located in upper and/or lower walls of the gate. Further, it is known in the art that very small adjustments to an injection location and orientation creates significant performance implications. The 90° angle orientation of the injection port in the discharge gate has been discovered to be very beneficial in promoting desired distribution of foam throughout the slurry.

Also, it is important to keep the cavity of the discharge gate full of slurry as the slurry flows from the mixing chamber for enhancing foam and slurry blending in the discharge gate. While the mixing dynamics of the foam and the slurry are somewhat unpredictable, it is important to achieve uniform mixing of the foam with the moving slurry as it exits the gate. In the present mixer gate, a gate filler block is installed inside the gate for more readily filling the gate with slurry. As such, the foam injected into the gate is more uniformly mixed with the slurry.

In one embodiment, a discharge gate for a gypsum slurry mixer is provided, and includes a lower member having an inlet opening configured for receiving the slurry, and an outlet opening configured for delivering the slurry to a dispensing device. An upper member is attached to the lower member, at least one of the upper and lower members having at least one opening for accommodating insertion of an injection port for introducing the foam to the slurry. A cavity is defined in the gate and is configured for mixing the foam and slurry, and is defined by inner surfaces of the lower member and the upper member.

In another embodiment, a gypsum wallboard slurry mixer discharge gate is provided. Included in the discharge gate is a lower member having an inlet opening configured for receiving the slurry, and an outlet opening configured for delivering the slurry. Also included in the discharge gate is an upper member attached to the lower member, wherein at least one of the upper and lower members has at least one opening for accommodating insertion of an injection port for introducing the foam to the slurry. In the preferred embodiment, the injection port is oriented generally perpendicular to a direction of flow of slurry through the discharge gate. A cavity is constructed and arranged for mixing the foam and slurry in the discharge gate, and is defined by inner surfaces of the lower member and the upper member. A gate filler block having an inlet side and an outlet side is inserted into the cavity, wherein the inlet side has an inclined ramp continuously following along a contour of the inlet opening of the discharge gate.

DETAILED DESCRIPTION

Figure 1:
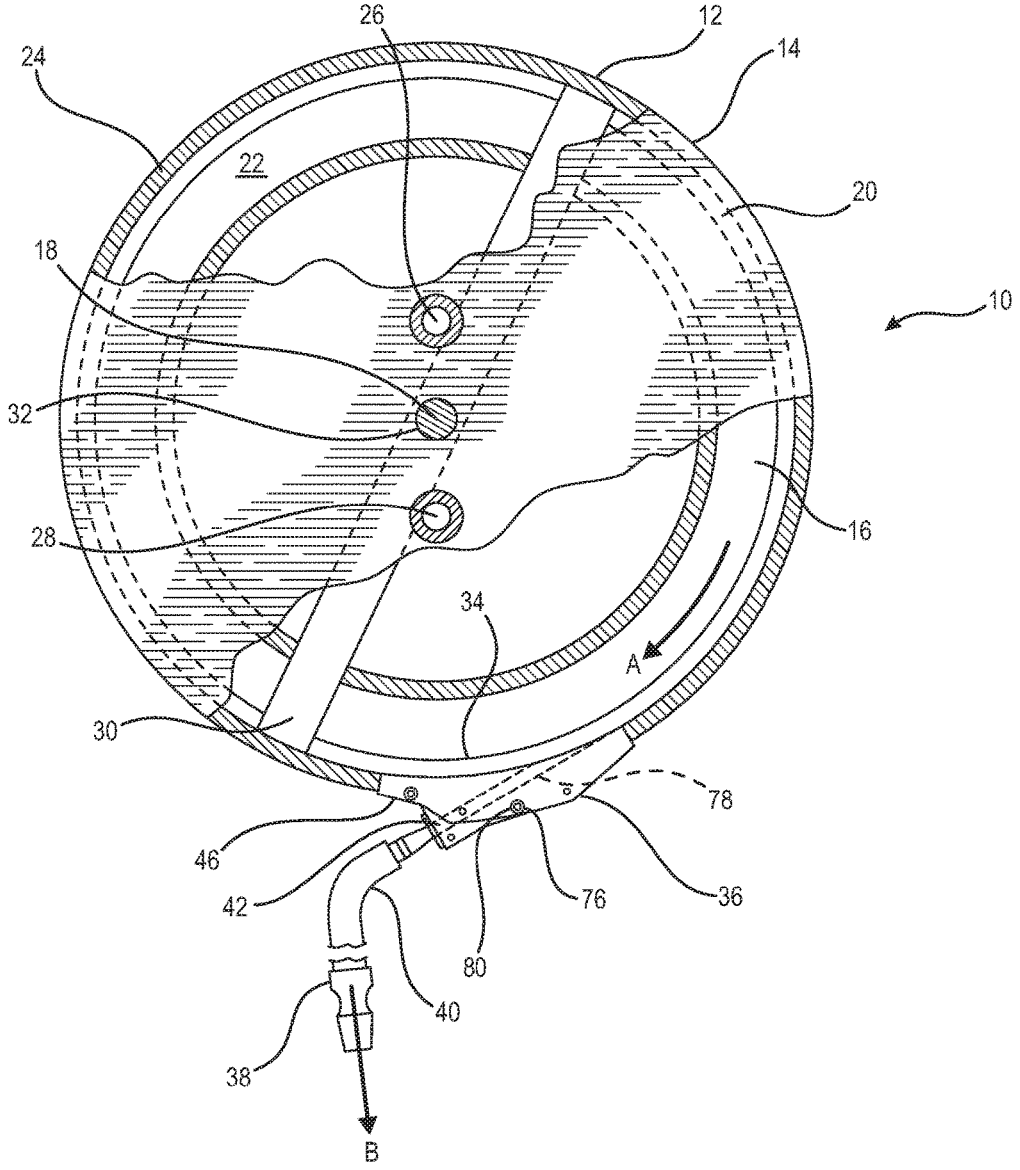
FIG. 1 is a fragmentary schematic plan view of a mixing apparatus incorporating the features of the present discharge gate.

Referring now to FIG. 1, an exemplary mixing apparatus for mixing and dispensing a slurry is generally designated 10 and includes a mixer 12 having a housing 14 configured for receiving and mixing the slurry. The housing 14 defines a mixing chamber 16 which is preferably generally cylindrical in shape, has a generally vertical axis 18, an upper radial wall 20, a lower radial wall 22 and an annular peripheral wall 24. An inlet 26 for calcined gypsum and an inlet 28 for water are both positioned the upper radial wall 20, preferably proximate to the vertical axis 18. It should be appreciated that the inlets 26, 28 are connected to gypsum and water supply containers respectively (not shown), such that gypsum and water can be supplied to the mixing chamber 16 by simple gravity feed. Also, as is well known in the art, other materials or additives in addition to gypsum and water, often employed in slurries to prepare gypsum products (e.g. accelerators, retarders, fillers, starch, binders, strengtheners, etc.) can also be supplied through these or other inlets similarly positioned.

An agitator 30 is disposed in the mixing chamber 16 and has a generally vertical drive shaft 32 positioned concentrically with the vertical axis 18 and extends through the upper radial wall 20. The shaft 32 is connected to a conventional drive source, such as a motor, for rotating the shaft at whatever speed is appropriate for agitating the agitator 30 to mix the contents of the mixing chamber 16. Speeds in the range of 275-300 rpm are common. This rotation directs the resulting aqueous slurry in a generally centrifugal direction, such as in a clockwise outward spiral indicated by the arrow A. The direction of rotation is a function of the mixer and gate design and/or construction, and may vary to suit the application. It should be appreciated that this depiction of an agitator is relatively simplistic and meant only to indicate the basic principles of agitators commonly employed in gypsum slurry mixing chambers known in the art. Alternative agitator designs, including those employing pins or paddles, are contemplated. In addition, the present gate design is contemplated for use with pinless mixers used for agitating gypsum slurries.

At a mixer outlet 34, a discharge gate 36 is attached to the peripheral wall 24 of the mixer 12 for the discharge of the major portion of the well-mixed slurry into a dispensing apparatus 38 via a conduit 40 in a direction indicated by the arrow B. As is known in the art, the ultimate destination of the slurry emitted by the dispensing apparatus is a gypsum wallboard production line, including a moving conveyor belt. While the geometry of the outlet 34 is shown as rectangular in cross-section, other suitable shapes are contemplated depending on the application. Also, while it is contemplated that the specific configuration of the mixer 12 may vary, it is preferred that the present mixer is of the centrifugal type commonly used in the manufacture of gypsum wallboard, and also of the type in which the outlet 34 dispenses the slurry tangentially to the housing 14. A cutoff block 42 is integrally formed with the discharge gate 36 to mechanically adjust the flow of slurry for the desired thickness of wallboard, typically ranging from ¼" to 1".

During operation, the cutoff block 42 often creates a site for the premature setting of gypsum, resulting in slurry buildup and eventual clogging and disruption of the production line. Further, when the discharge gate 36 is set for thick wallboard and a conversion is made to thin wallboard, insufficient backpressure is provided in the mixing chamber 16, which in some cases results in an incomplete and nonuniform mixing of slurry constituents. Also, the inadequate backpressure results in dead spots or slow spots in the centrifugal internal flow in the mixing chamber 16, causing premature setup of the slurry and unwanted lumps in the mixture. In such instances, the wallboard line must be shut down for maintenance, causing inefficiencies in production. As explained in greater detail below, the present discharge gate 36 provides solutions to these operational problems.

Figure 2A:
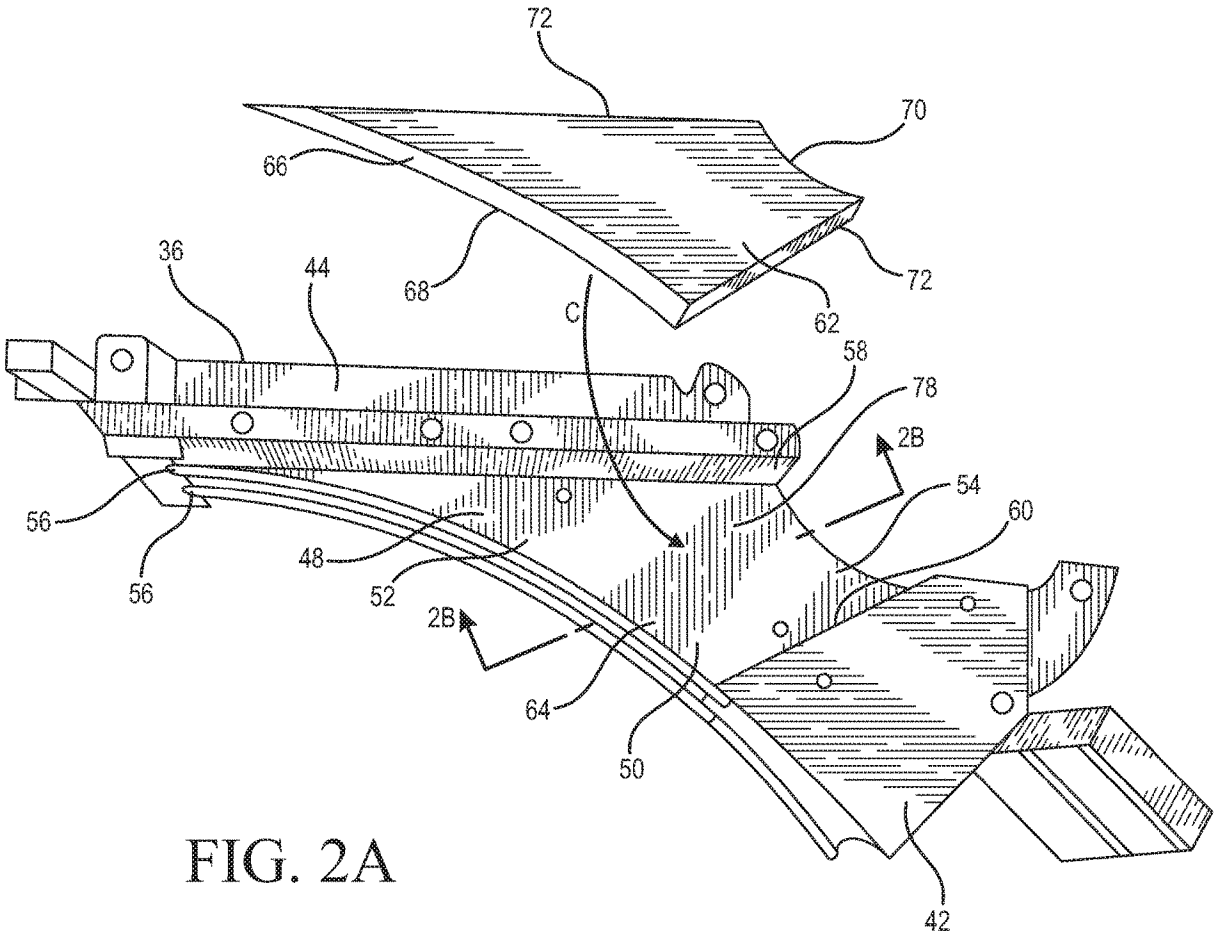
FIG. 2A is a schematic top perspective view of the present discharge gate, featuring a lower member and a gate filler block.
Figure 2B:
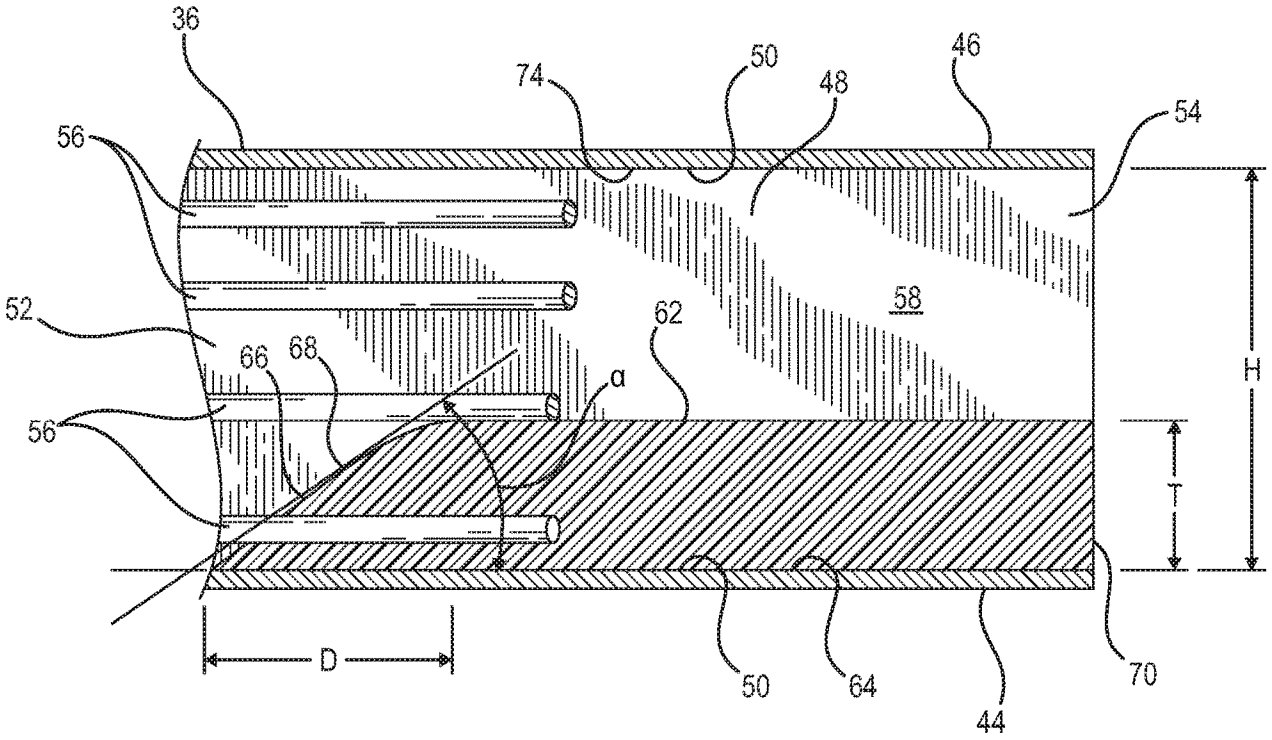
FIG. 2B is a vertical cross-section taken along the line 2B-2B of FIG. 2A and in the direction generally indicated.
Figure 3:
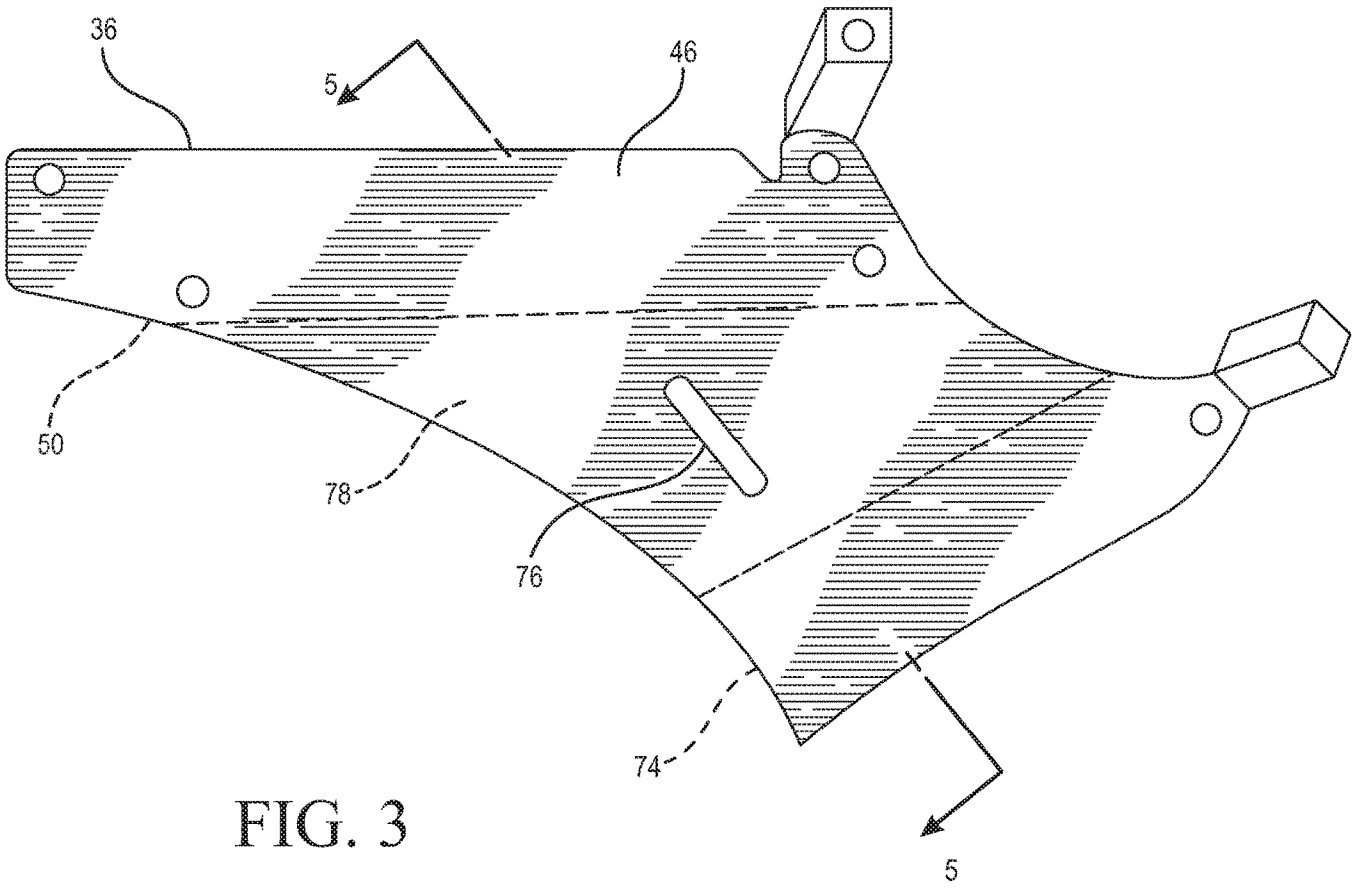
FIG. 3 is a schematic plan view of the present discharge gate, featuring an upper member having an injection opening.

Referring now to FIGS. 2-3, it is preferred that the discharge gate 36 includes a lower member or body 44 (FIG. 2A) and an upper member or plate 46 (FIG. 3), wherein the lower and upper members are attached together to define a cavity 48 between inner surfaces 50 of the lower and upper members for mixing the slurry from the mixing chamber 16 and the foam. Typically, the upper and lower members 44, 46 are separated a distance generally corresponding to the upper and lower mixer radial walls, 20, 22. As discussed in greater detail below, the foam is injected from the upper member 46.

Included in the lower member 44 are an inlet opening 52 configured for receiving the mixed slurry from the mixing chamber 16, and an outlet opening 54 configured for delivering the mixed slurry to the dispensing apparatus 38 (FIG. 1). The inlet opening 52 generally follows a contour or profile of the annular peripheral wall 24 of the housing 14 (FIG. 1). Also included in the lower member 44 is a plurality of lump bars 56 being connected at one end to a first side wall 58 of the lower member, and at an opposite end, to an opposite second side wall 60 of the lower member, for preventing the slurry lumps from entering into the cavity 48 of the discharge gate 36. The second side wall 60 is part of the cutoff block 42. Attachment of the lower and upper members 44, 46 is achieved by using the first and second side walls 58, 60 and conventional fasteners, adhesives, welding, or other suitable methods known in the art.

An important feature of the present discharge gate 36 is that a gate filler block 62 having a predetermined thickness T (FIG. 2B) is provided to reduce the slurry buildup and clogging within the cavity 48. In the preferred embodiment, the gate filler block 62 is made of metal, but other equivalent, durable materials are contemplated. An outer periphery of the gate filler block 62 generally follows an outline of an inner bottom surface 64 of the lower member 44, such that the filler block substantially covers the inner bottom surface between the first and second side walls 58, 60. In the preferred embodiment, the use of the gate filler block 62 decreases a volume of the cavity 48 by approximately 50%.

Referring now to FIGS. 2A and 2B, an inclined ramp or edge 66 is provided at an inlet side 68 of the gate filler block 62, continuously following along a contour or profile of the inlet opening 52 of the lower member 44. As a result, when the gate filler block 62 is inserted into the cavity 48 as indicated by the arrow C, the inlet side 68 of the filler block aligns with the contour of the inlet opening 52 of the lower member 44, and an opposite outlet side 70 of the filler block aligns with the contour of the outlet opening 54 of the lower member. Also, side edges 72 of the gate filler block 62 directly abut against the first and second side walls 58, 60 of the lower member 44.

An exemplary angle α (FIG. 2B) of the ramp 66 is approximately 30 degrees, gradually inclining from the inlet side 68 to the outlet side 70 of the gate filler block 62 for a predetermined distance D, and maintains the predetermined thickness T after reaching the distance. It is contemplated that an amount of the distance D is variable to suit the application. The inclined ramp 66 facilitates a smooth flow of the mixed slurry from the mixing chamber 16, and thus does not disrupt the slurry flow while entering into the cavity 48 of the discharge gate 36. Further, the predetermined thickness T of the filler block 62 reduces an overall internal height H of the cavity 48 in the discharge gate 36, and allows a more even distribution of the mixed slurry in the cavity for the foam injection operation.

This configuration of the gate filler block 62 allows that a volumetric area of the cavity 48 is matched to the volume of mixed slurry flowing through therein, and that the foam is distributed and filled evenly and uniformly for providing a desired mixture of the foam and slurry. While the gate filler block 62 is shown that is installed on the inner bottom surface 64 of the lower member 44, it is also contemplated that the gate filler block is optionally installed on an inner top surface 74 (FIGS. 2B, 3 and 5) of the upper member 46 inside the cavity 48.

Referring now to FIGS. 1, 2A and 3, at least one of the upper member 46 and the lower member 44 has at least one injection opening or foam slot 76 positioned near or at a center of a slurry passageway 78 defined by the cavity 48. While only one injection opening 76 is shown in FIG. 3, any number of openings is contemplated depending on the application. Locations of the openings 76 are preferably in the middle of the slurry passageway 78, but other locations in the passageway are contemplated to suit the application. In another embodiment, the openings 76 may be disposed in the passageway 78 of the lower member 44, or both the lower and upper members 44, 46, respectively. It is preferred that the opening 76 is linear, resembling a coin slot opening, but other nonlinear geometrical shapes, such as zigzag, elliptical, and irregular figures, are contemplated.

Figure 4:
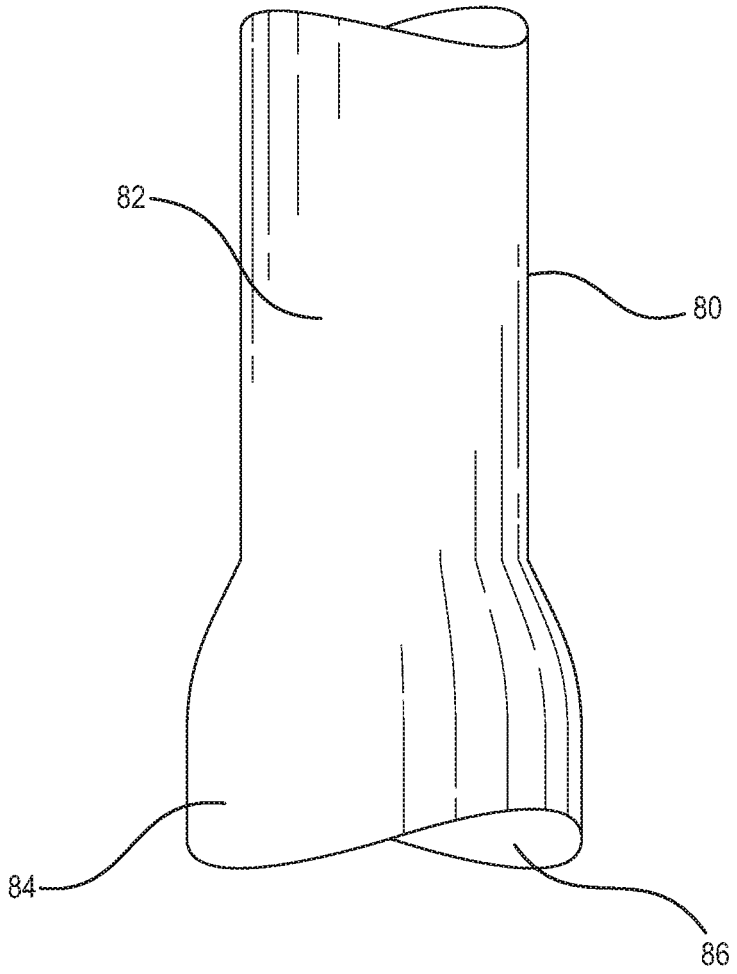
FIG. 4 is an enlarged schematic front view of an exemplary injection port.

As illustrated in FIGS. 1 and 4, the foam is injected through the opening 76 in the upper member 46 of the discharge gate 36 using an injection port 80 (FIG. 4) for introduction of aqueous foam or other desired additives. As discussed above, depending on the location of the corresponding opening 76, the discharge gate 36 may have a single upper or lower injection port, or multiple injection ports to suit the application.

Figure 5:
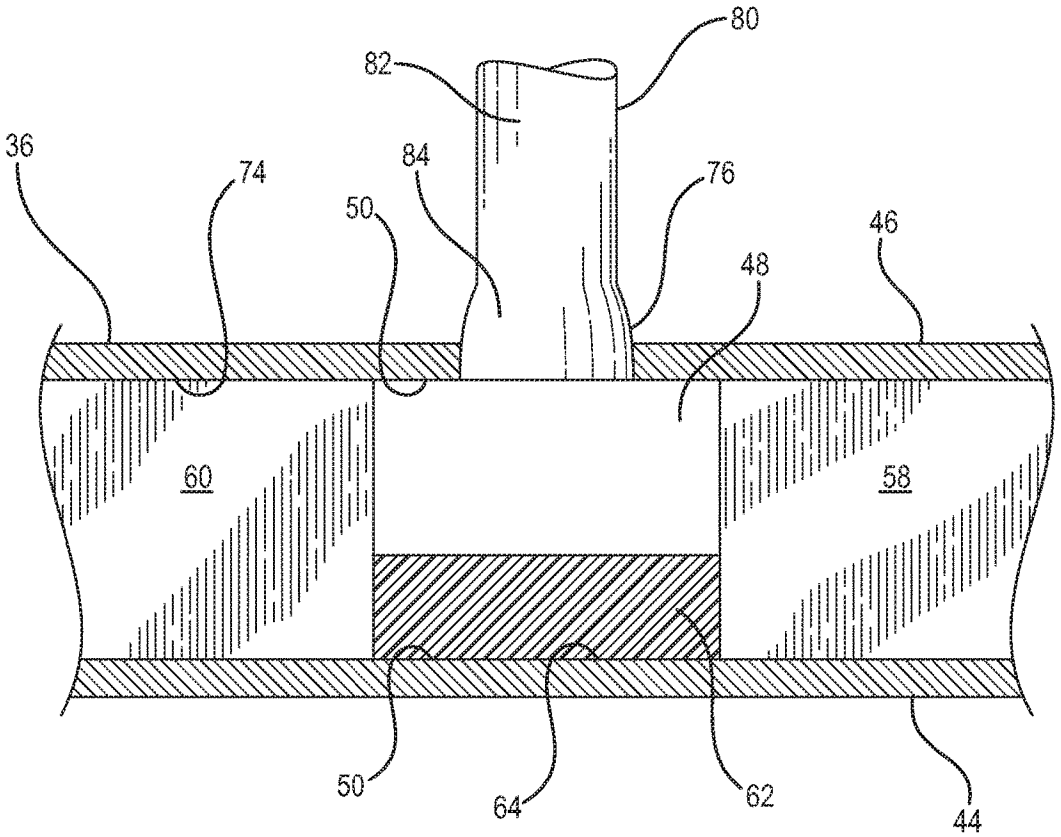
FIG. 5 is a vertical cross-section taken along the line 5-5 of FIG. 3 and in the direction generally indicated, featuring the injection port of FIG. 4 installed on the upper member of the present discharge gate.

Referring now to FIGS. 4 and 5, the injection port 80 has an elongate body 82 and a flared outlet end 84 sized to fit the opening 76 for injecting the foam into the cavity 48 of the discharge gate 36. It is preferred that the end 84 is flared for increasing pressure of the emitted foam. Thus, the foam is more evenly mixed with the slurry passing through the discharge gate 36. In the preferred embodiment, the elongate body 82 has a cylindrical shape, but other suitable shapes are contemplated to suit different applications. Also, it is preferred that the flared end 84 has a generally long narrow opening 86 to fit the opening 76, but other suitable types of openings are contemplated.

An important aspect of the present injection port 80 is that the port is attached to the upper member 46 in fluid communication with the opening 76 such that the foam passes through the port, and is injected into the moving slurry in the cavity 48 at an approximately 90° angle relative to the running direction of the slurry flow in the discharge gate 36. The flared end 84 of the injection port 80 is preferably substantially flush with the inner top surface 74 of the upper member 46 inside the cavity 48. This configuration of the injection port 80 achieves the desired foam injection angle of 90 degrees relative to the slurry flow, and prevents the form and/or additives from flowing back and entering into the mixing chamber 16 (FIG. 1).

It has been found that the present mixer gate configuration, particularly with the gate filler block, has facilitated the dispensing of gypsum slurries from mixers with reduced lumps, and while maintaining desired flow volumes. Also, the introduction of the foam into the slurry is performed so that there is less risk of foam being reintroduced into the mixer. The present gate is also usable with conventional gate bars provided to reduce the flow of lumps into the slurry downstream of the mixer.

While a particular embodiment of the present discharge gate has been shown and described, it will be appreciated by those skilled in the art that changes and modifications may be made thereto without departing from the present disclosure in its broader aspects.

What is claimed:

1. A discharge gate for a gypsum slurry mixer with a housing having an annular peripheral wall, comprising:

a lower generally planar member defining in part a generally rectangular inlet opening configured for receiving the slurry, and an outlet opening configured for delivering the slurry to a dispensing device, the inlet opening defines an annular edge that engages the annular peripheral wall of the housing;

an injection port constructed and arranged for introducing foam into a slurry formed in the mixer;

a generally planar upper member attached to and vertically spaced from the lower member, said upper member also having an annular edge that engages the annular peripheral wall of the housing, at least one of the upper and lower members having at least one injection opening constructed and arranged for accommodating insertion of said injection port for introducing the foam to the slurry;

a cavity configured for mixing the foam and slurry, and defined by inner surfaces of the lower member and the upper member;

a gate filler block being inserted into the cavity, and having an inlet side located in said inlet opening and an outlet side, and configured for reducing the volume of the cavity by substantially covering an inner surface of at least one of said upper and lower members.

2. The discharge gate of claim 1, wherein the inlet side of the gate filler block has an inclined ramp and said gate filler block reduces a volume of said cavity by approximately 50%.

3. The discharge gate of claim 2, wherein said inclined ramp continuously follows said annular edge of said inlet opening of the discharge gate.

4. The discharge gate of claim 1, wherein said injection port has a flared outlet end.

5. The discharge gate of claim 1, wherein said injection port is oriented generally perpendicular to a direction of flow of slurry through the discharge gate.

6. A gypsum wallboard slurry mixer discharge gate for a gypsum slurry mixer with a housing having an annular peripheral wall, comprising:

a generally planar lower plate having an inlet opening configured for receiving the slurry, and an outlet opening configured for delivering the slurry;

a generally planar upper plate attached to the lower plate;

an injection port configured for insertion into one of said lower plate and said upper plate;

at least one of the upper and lower plates has at least one injection opening for accommodating insertion of said injection port for introducing the foam to the slurry, said injection port being oriented generally perpendicular to a direction of flow of slurry through the discharge gate, said inlet opening generally follows a contour of the annular peripheral wall of the housing;

a cavity is constructed and arranged for mixing the foam and slurry in the discharge gate, and is defined by inner surfaces of the lower plate and the upper plate; and a gate filler block having an inlet side located in said inlet opening and an outlet side is inserted into the cavity, said gate filler block substantially covering an inner surface of one of said upper and lower plates, the inlet side has an inclined ramp continuously following along an annular edge of the inlet opening of the discharge gate, which engages said annular contour of the peripheral wall of the housing.

* * * * *